United States Patent [19]

Jukkola et al.

[11] 4,152,110

[45] May 1, 1979

[54] DRY COAL FEED SYSTEMS FOR COMBUSTION REACTORS

[75] Inventors: Walfred W. Jukkola, Westport; Richard E. Svencer, Norwalk, both of Conn.

[73] Assignee: Dorr-Oliver Incorporated, Stamford, Conn.

[21] Appl. No.: 866,668

[22] Filed: Jan. 3, 1978

[51] Int. Cl.[2] ..... F27B 15/00; F23K 3/02

[52] U.S. Cl. ..... 432/14; 110/106; 432/58

[58] Field of Search ..... 110/106; 432/14, 15, 432/58

[56] References Cited

U.S. PATENT DOCUMENTS

| | | | |
|---|---|---|---|
| 2,845,883 | 8/1958 | Sherban | 110/106 |
| 3,205,843 | 9/1965 | Bogot | 110/106 |
| 3,263,338 | 8/1966 | Gordon | 432/58 |
| 3,793,743 | 2/1974 | Kemmetmueller | 432/58 |
| 3,969,068 | 7/1976 | Miller et al. | 110/106 |
| 4,082,498 | 4/1978 | Offergeld et al. | 432/14 |

*Primary Examiner*—John J. Camby

*Attorney, Agent, or Firm*—Harold M. Snyder; Burtsell J. Kearns

[57] ABSTRACT

Systems for the comminution, drying and dry feed of coal for combustion in fluid bed calciners, incinerators, or other combustion systems.

13 Claims, 2 Drawing Figures

150
151
152
152a
153
155
157
159
200
201
203
204
189
187
185
137
205
191
190
120
121
122
124
125
126
127
129
130
132
134
140
142
144
146
180
181
182
250
251
253
254
257
259
163
165
166
167
169
172
173
175
177
111
112
114
150

DRY COAL FEED SYSTEMS FOR COMBUSTION REACTORS

This invention is directed to a system for using coal as the fuel for fluid bed calciners or incinerators or other combustion systems.

Most existing fluid bed calciners and incinerators were designed for operation using gas and liquid fuels. The rising cost and growing scarcity of such fuels has led to increased attention being devoted to the enormous coal reserves which are available and which could, potentially, replace gas and liquid fuels in fluid bed systems.

The use of coal as fuel presents many problems such as possible fires, explosion hazards and handling difficulties due to the varying chemical and physical properties of coal as received at the plant for use. The characteristics of the coal are largely dependent upon its rank or source. Coals are typically classified as Anthracite, Bituminous, Semibituminous or Lignites dependent upon age, chemical analysis, volatile composition, physical characteristics, etc. with each rank having particular characteristics. As coal is usually shipped and stored in the open, the moisture content and handling characteristics are largely determined by weather conditions as well as the size distribution of the coal.

Elaborate and complex systems have been devised for coal preparation, but such systems are only feasible where very large tonnages of coal are to be prepared and consumed. However, there exists a need for a system of coal preparation for an operation which uses only a fraction of a ton, or perhaps a few tons per hour, as fuel and therefore does not justify a complex fuel preparation system.

Accordingly, it is an object of this invention to provide a simple, safe and efficient method and system for coal preparation for use as fuel in fluid bed reactors where generally the fuel must be introduced into a pressurized combustion zone.

Figure 1:
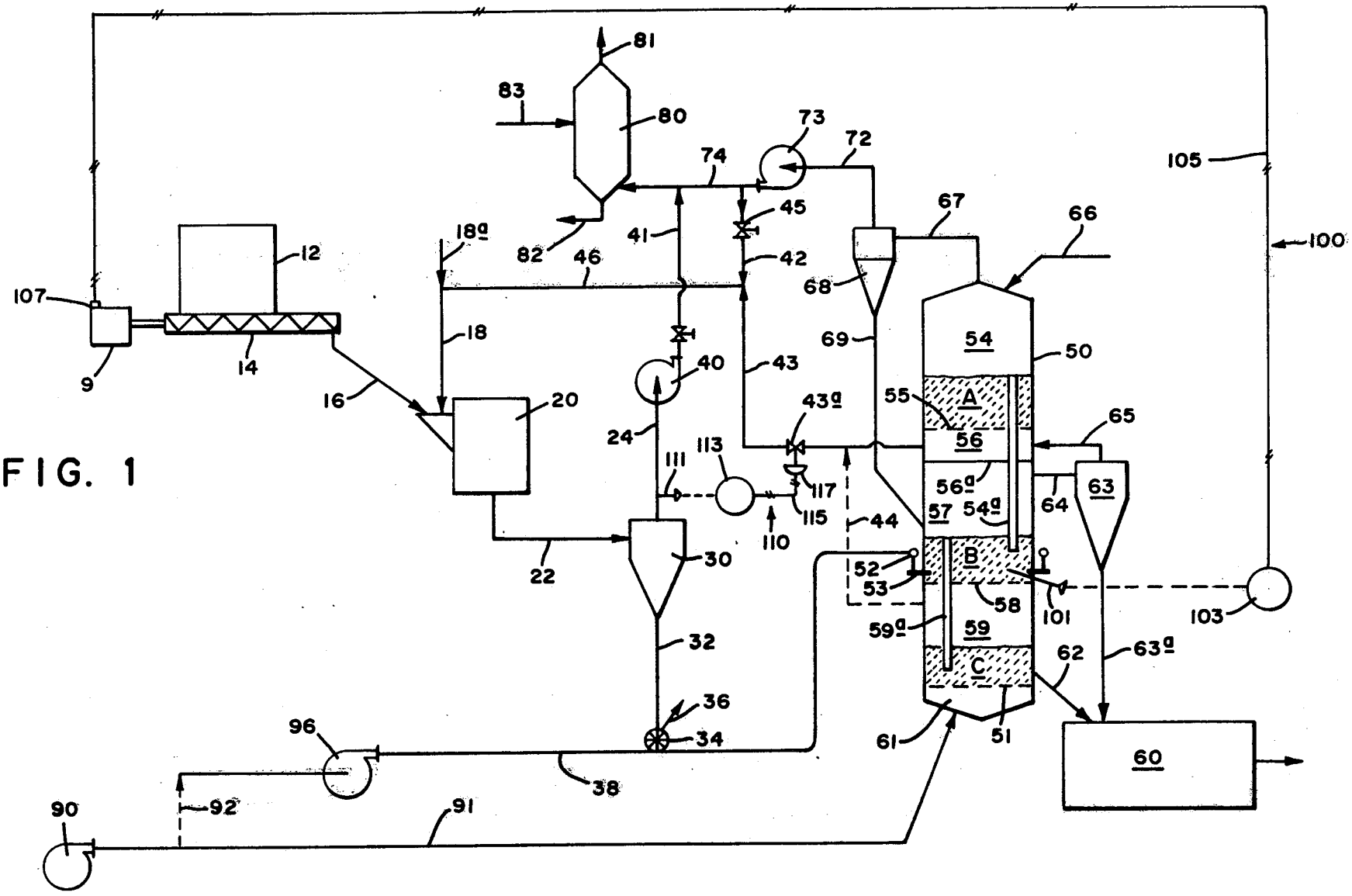
Figure 2:
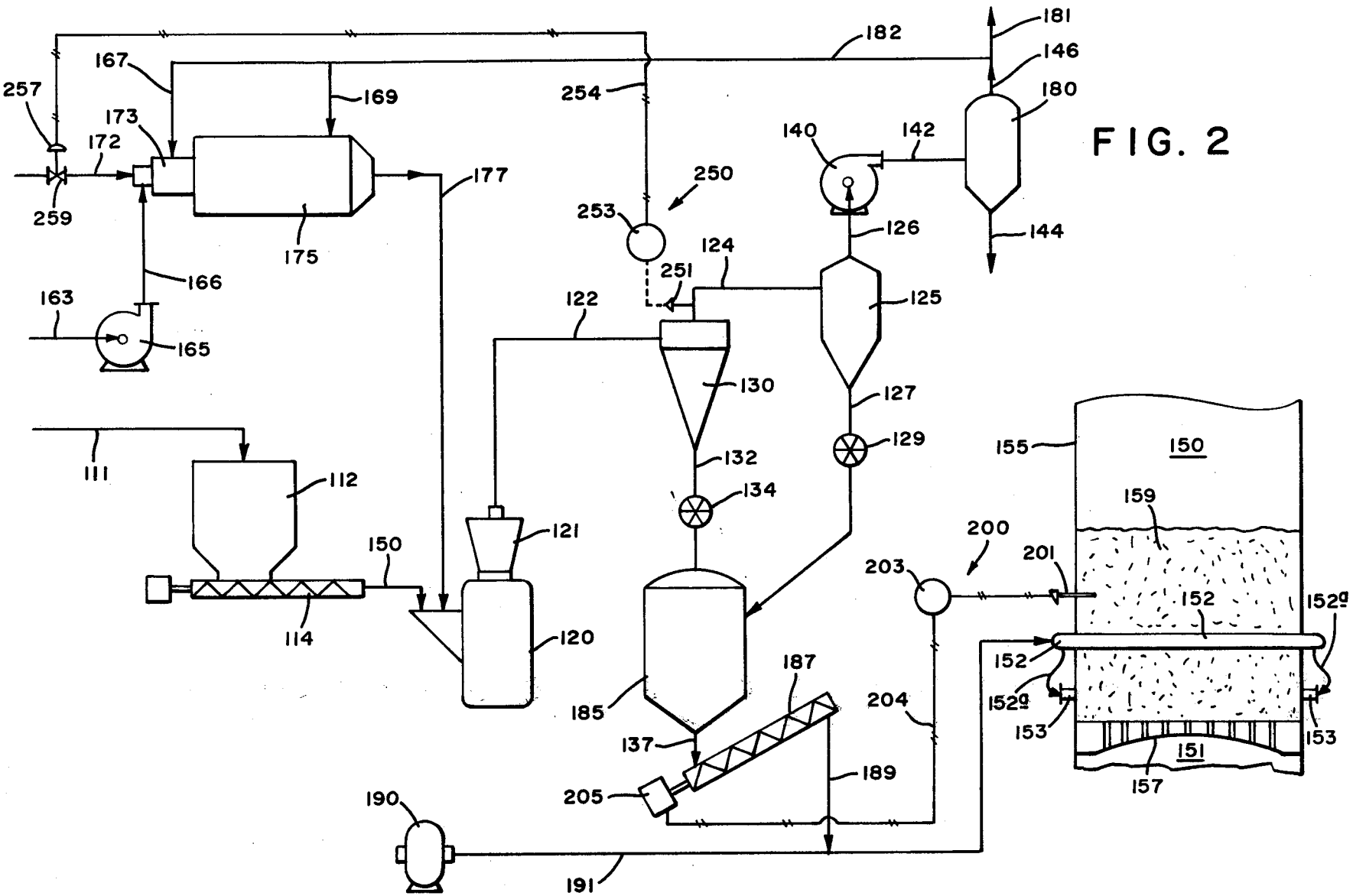

Other objects and advantages of the invention will become apparent in the following description, taken in conjunction with the accompanying drawings of which:

FIG. 1 is a schematic diagram of a coal preparation system for a fluid bed calciner in accordance with this invention; and FIG. 2 is a schematic diagram of a modified coal preparation system for a fluid bed incinerator in accordance with this invention.

Generally speaking, the coal preparation and combustion system of the invention, wherein coal is burned at a combustion site as fuel, comprises a coal bin, a coal crusher, transport means for withdrawing coal from the bin and forwarding it to the coal crusher, the coal crusher having an inlet for admitting heated gas whereby coal introduced into the crusher for processing is dried as it is comminuted to fine particle size and conveyed therefrom by the gas, a crusher product conduit accommodating the gas-conveyed coal and connecting the crusher to a gas-solids separating unit, the gas-solids separating unit operating to separate the heated gas from the fine particle coal, a solids handling means connecting the separating unit to a pneumatic carrier conduit whereby the fine particle coal is introduced into the carrier conduit for transport to the combustion site, a drying gas conduit connected to the inlet of said crusher for conducting hot, relatively inert, combustion gases from a combustion reaction toward the crusher inlet and a tempering conduit connected to a source of relatively cool gas and arranged to blend the cool gas with the hot combustion gases ahead of the inlet to produce a predetermined volume of warm, inert gas for drying the coal within the coal crusher.

More particularly, the combustion site is the reaction chamber of a fluid bed reactor and conduit means may be provided for withdrawing combustion gases from the reactor and routing these gases to the inlet of the coal crusher after tempering with cooler gases. Further, the gas discharged from the coal crusher after performing its drying function may be routed to a scrubber with the exhaust gas from the reactor.

Turning to the drawings, in FIG. 1 a screw feed mechanism 14 is positioned to withdraw coal from the coal surge bin 12 and move it to conduit 16 which is connected to the impact crusher 20. The impact crusher 20 has a warm air inlet 18 and a solids outlet conduit 22 for removing the crushed coal from the impact crusher 20. The fine, crushed coal, typically minus ¼" size, is pneumatically conveyed through conduit 22 by the warm air introduced into the impact crusher through warm air inlet 18. Conduit 22 delivers the stream of fine, crushed coal to the cyclone 30 where a gas-solids separation is effected, with the crushed coal departing the cyclone through conduit 32 and the gas leaving through conduit 24 assisted by the exhaust fan 40 in line 24 which forwards the gases through line 41.

The fluid bed calcining reactor 50 is a multicompartment reactor having a preheat compartment 54 separated from a windbox 56 by a constriction plate 55. The calcining compartment 57 is separated from the windbox 56 by a solid partition **56*a*. A constriction plate 58 separates the calcining compartment 57 from the cooling compartment 59. A windbox 61 is separated from the cooling compartment 59 by the constriction plate 51. The fluidizing air blower 90 supplies fluidizing air to the windbox 61 through the conduit 91. The material to be calcined is supplied to the preheat compartment 54 through conduit 66. The calcined, partially cooled product is withdrawn from cooling compartment 59 through conduit 62 to a calcine cooling system 60** in which the cooling process is completed.

The fluidizing air supplied to windbox 61 traverses the constriction plate 51 to fluidize the cooling bed C in cooling compartment 59 and, in the process, is heated to a somewhat elevated temperature. This heated air rises through cooling compartment 59 and traverses the constriction plate 58 to fluidize the bed in the calcining compartment 57. In that chamber combustion occurs and the gases which rise through calcining compartment 57 are quite hot. These gases are routed through conduit 64 to the cyclone 63, where entrained solids are removed through conduit **63*a* to the calcining cooling system 60. The hot gases leave the cyclone 63 through conduit 65 through which they are routed to the windbox 56. The hot gases from windbox 56 traverse the constriction plate 55 to fluidize the bed in the preheat compartment 54. In rising through the fluidized bed the gases are cooled considerably and pick up a substantial amount of moisture. The gases from preheat compartment 54 exit through conduit 67 and are conducted to the cyclone 68 where entrained solids are separated and returned to the calcining compartment 57 through conduit 69, while the gases drawn from cyclone 68 through the conduit 72 by the exhaust fan 73 are directed to the scrubber 80. Scrubber water is introduced into the scrubber 80 through the conduit 83. The scrubbed gases leave the scrubber 80 through conduit 81 for discharge or further treatment while liquids depart the scrubber through conduit 82**.

Considering now the solids flow in reactor 50, as mentioned previously, the material to be calcined is introduced through the conduit 66 to the preheat compartment 54 where it forms fluidized bed A resting on the constriction plate 55. The overflow transfer pipe 54*a* is provided extending from a position well within the preheat compartment 54, through the constriction plate 55 and partition 56*a* to a position below the upper surface of the fluidized bed B in the calcining compartment 57. The fluidized bed A in preheat compartment 54 reaches the upper lip of the transfer pipe 50 as material is added to the compartment and, with the bed fluidized, preheated bed material overflows the lip and falls into calcining compartment 57.

The solids introduced into calcining compartment 57 through the transfer pipe 54*a* form a fluidized bed B in that chamber resting on the constriction plate 58. A second transfer pipe 59*a* extends from well within calcining compartment 57 through constriction plate 58 into cooling compartment 59, well below the level of the fluidized bed C situated therein. This transfer pipe works in an identical manner to that just described, thus establishing the level of the fluidized bed B in compartment 57, while the overflow falls through the transfer pipe 59*a* to establish a fluidized bed in cooling compartment 59. In summary, it may be stated that the solids flow in reactor 50 is countercurrent to the gas flow through the reactor.

The carrier air blower 96 supplies carrier air through conduit 38 which receives a flow of fine coal from conduit 32 through the rotary feed valve 34. The conduit 38 thus provides a pneumatic delivery system for the crushed coal which conveys the coal to the bustle pipe 52 which surrounds the reactor 50 at the level of the calcining compartment 57. The bustle pipe 52 is connected to a plurality of fuel guns 53 which project into the compartment 57. The fine coal is thus delivered into the calcining compartment 57, preferably directly into the fluidized bed B therein, for combustion. The air injected into the calcining compartment 57 with the crushed coal serves as a part of the combustion air required in the calcining compartment.

The relatively inert gas required for drying the crushed coal in the impact crusher 20 is supplied primarily by tapping the hot windbox 56 by means of a conduit 43 which conveys this hot inert calciner exhaust gas through conduits 46 and 18 into the impact crusher 20. Since the gas from the hot windbox 56 may be excessively high in temperature, the gas may be tempered by tapping the over bed region or freeboard of the cooling compartment 59 by means of conduit 44 through which this gas may be conveyed to conduit 43. However, it must be recognized that the gas in cooling compartment 59 will have a high oxygen content so that only a small amount of this gas may be used if the inert character of the drying gas is to be preserved.

Another source of tempering gas is the exhaust gas from the reactor which exits the reactor through conduit 67. This gas is at a substantially lower temperature than gas from the hot windbox 56 because it has performed a heating function in the preheating compartment 54. In addition, it can be expected that gas from this source will have a relatively high moisture content picked up in the course of preheating and drying the incoming calciner feed.

Since the mixed gases are to perform a drying function in impact crusher 20 it is well to limit the amount of moisture introduced with the gases because such moisture will tend to restrict the drying effect of the gases. As a further source of tempering gas, air may be introduced through a line 18*a*, but again, the amount of such air which can be introduced will be limited by the degree to which the gases must be maintained at an inert level.

It should be noted that the off gases from the impact crusher 20 which have been separated in the cyclone 30 are forwarded to line 74 through conduit 41 so that they are routed to the scrubber 80 with the off gases from the reactor 50. Thus, no separate scrubber system is required for the drying gases.

Automatic coal feed is provided by a control circuit 100. This control circuit comprises a temperature sensor or thermocouple 101 connected to a control instrument 103 which functions, through a pneumatic or electrical line 105, speed regulator 107 and operating mechanism 9, to drive or stop feed screw 14.

The drying conditions in impact crusher 20 may also be controlled, if desired, by a control circuit 110 which comprises a temperature sensor 111, a control instrument 113 connected to a valve operating means 117 for valve 43*a* by a pneumatic or electrical line 115. It will be seen that, through this control means, the flow of hot gas through conduit 43 can be increased or decreased by means of valve 43*a* in response to the temperature detected in line 24.

The selected source of heated gases will be dependent upon the type and properties of coal being used and the operating conditions within the reactor. In the case of a calciner, if the stack gases are at a temperature of about 300° F. or higher and have a moisture dew point less than 160° F., these gases could be advantageously used in the crushing-drying stage. Their use would have no effect on the calciner operation and no effect upon the fuel requirements of the system as only waste heat would be utilized. Further, this stack gas is essentially inert, normally having only 3 to 6% $O_2$ content.

When semi-bituminous coal or any coal having great flameability tendencies and/or explosive characteristics, then the use of essentially inert gas in the crushing-drying stage is necessary. It has been established that drying gases containing less than 12% $O_2$ are safe for drying fine coals. As explained above, a source for high temperature, essentially inert gases, is available from the freeboard zone of the calcining compartment and the hot windbox. Generally at this location the $O_2$ content is only about 2 to 3%. This high temperature inert gas can be tempered with air or with the reactor stack gases to obtain the desired warm drying gas for the crushing-drying stage.

The use of the hot gases from the calciner freeboard or hot windbox has little effect on the calciner capacity or its fuel requirements as the fuel has already released most of its potential energy to the calcining system.

An ideal source of hot air, for cases where hot air can be safely used in the crushing-drying stage, is the cooling compartment freeboard. In many calcining operations the air is preheated to a temperature of 500° F. to 800° F. in the cooling compartment. No special or unusual material of construction is required to handle the hot air in this temperature range.

Similarly, in incineration operations one or more sources of hot air or low oxygen gases are available. In hot windbox incinerators, gases at the outlet of the heat exchanger or from the reactor freeboard are available sources for the heated gases.

While FIG. 1 shows a continuous crushing-drying and coal injection system, it is obvious that a storage bin for the crushed, dried coal can readily be used. The coal collected by the cyclone can be discharged directly into a storage bin through a sealing valve system similar to that employed for the pneumatic conveying system. The dried coal can then be withdrawn from the storage bin as required and used in one or more fluid bed systems. Also, several coal metering devices can be installed in the storage bin to control delivery of coal to the reactors.

The system just described for using blended gases from the fluid bed reactor is a suitable and safe means for handling any type and moisture content coal as fuel for fluid bed systems. The temperature of the blended gases at the inlet of the impact crusher is generally in the range of 300° to 600° F. with a maximum oxygen content of no more than 6 to 8% oxygen. The temperature of the outlet gases from the cyclone separator will generally not exceed about 150° F. The hot and cooler gases are blended to the required ratios and volumes to maintain the desired temperatures in the crushing-drying stage. The crushed-dried coal is generally conveyed with compressed air using 5 to 15 SCF of air per pound of coal. The precise requirement for air will depend on the size distribution of the coal and the capacity of the conveying lines used. Conveying the crushed coal through pneumatic lines is quite safe because the high-velocity movement through the lines results in a very low detention time for coal particles in the line. Also the velocity in the lines is faster than flame propagation velocity.

In FIG. 2 there is disclosed a system for the crushing and drying of coal with inert gases which is entirely independent of the gases produced by the reactions in the fluid bed reactor. The feed coal is introduced into the system through line 111 by which it is conveyed to the surge coal bin 112. The screw feeder 114 withdraws coal from the surge coal bin 112 sending it through line 150 to the impact crusher 120. Drying gas is introduced into the impact crusher through line 177 and this air picks up the fine coal particles generated in the impact crusher and forwards them through classifier 121 and on to the cyclone 130 through pneumatic line 122. In the cyclone 130 a gas-solid separation is effected with the solids leaving the cyclone through line 132 which is provided with the rotary seal valve 134. The gases depart the cyclone through conduit 124 which conducts the gases to the baghouse 125 for further gas-solids separation. The solids leave the baghouse through line 127 which is controlled by the rotary seal valve 129. The suction blower 140 withdraws the gases from the baghouse 125 through line 126 and forwards them to the scrubber-condenser 180 through line 142. The condensed liquid leaves the scrubber through line 144 for further treatment or discharge. The gases from the scrubber exit therefrom through line 146. A portion of the scrubber gases exits the system through line 181 for further treatment or discharge to the atmosphere but the largest volume is returned to the system through line 182 as will be explained hereinafter.

Returning now to the coal delivery aspect of invention, it will be noted that a storage bin 185 is provided which receives the fine coal from line 132 as well as from return line 127 from the baghouse 125. The stored coal fines are removed from the storage bin 185 through conduit 137 by the screw feed 187 which delivers the fine coal to line 189. Alternatively, a rotary feeder or other feeding mechanism could be used. Line 189 joins pneumatic conduit 191. Pneumatic conduit 191 has positioned therein the carrier gas blower 190 which provides a strong current of air in conduit 191 to pick up the coal fines delivered into the conduit from line 189. The coal fines are thus conveyed from carrier conduit 191 to the bustle pipe 152 which surrounds the fluid bed reactor 155 at the level of the fluid bed therein. The fluid bed reactor 155, shown only in part in the figure, comprises a reactor chamber 155 in which there is situated a fluidized bed 159 which rests on a constriction dome 157. The constriction dome 157 separates the windbox 151 from the reaction chamber 150.

The coal fines are forwarded to the fuel guns 153, situated at selected points about the fluid bed reactor 155, through the connecting conduits 152*a*. The fine coal is preferably injected directly into the fluidized bed 159.

Turning now to the means for providing the inert drying gas for the system, a preheater 175 is provided having a burner chamber 173 at one end thereof. Fuel is provided for the preheater through line 172. Oil, natural gas or pulverized coal may be used as the fuel. Combustion air is provided by the blower 165 which has an air inlet 163 and a delivery air conduit 166 which terminates in the burner portion 173 of the preheater 175. The combustion which occurs in burner 173 produces a gas product of relatively small volume having a temperature in the neighborhood of 2500° to 3500° F. Not only is the volume of gas produced by this combustion reaction too small to satisfy the requirements for drying in the impact crusher 120, but the temperature is far above the maximum of 600° F. which can be used for drying purposes. Accordingly, a source of inert tempering gases is needed, and the off-gases of the drying system which appear at conduit 146 from scrubber-condenser 180 very nicely serve this purpose. Thus, the gases from scrubber-condenser 180 are primarily routed through conduit 182 and only a small volume of the gas roughly equal to the combustion air introduced through line 163 is bled from the system through line 181. The inert gases in line 182 may be directed into the preheater at more than one point. For example, a portion of the gases may be directed into the burner 173 through line 167 which is connected to line 182. Another portion of the inert tempering the gases from line 182 may be directed into the tempering chamber of the preheater 175 to line 169 which is also connected to line 182. In any case, sufficient tempering air is introduced from lines 167 and 169 to reduce the temperature of the gas traversing line 177 toward impact crusher 120 to a maximum of 600° F.

An automatic control system 200 is provided for feeding coal into the reactor. A thermocouple 201 senses the temperature in the fluid bed 159 and the control instrument 203, in response thereto, actuates or deactuates the drive mechanism 205 of the screw feed 187. Control may also be provided for the generation of drying gases by controlling the fuel supply to the preheater 175. Thus, control circuit 250 includes a temperature sensor or probe 251 situated in conduit 124 to detect the temperature therein, a control instrument 253 connected to valve control means 257 by pneumatic or electrical line 254 and valve 259 located in fuel inlet 172. It will be seen that should the temperature of the gas in line 124 drop below or exceed a predetermined level, control circuit 250 will respond to open or close valve 259 to increase or decrease fuel delivery to the preheater 175.

Accordingly, there has been presented relatively simple systems capable of crushing and drying coal to serve as fuel in combustion reactions.

Although the present invention has been described in conjunction with preferred embodiments, it is to be understood that modifications and variations to be resorted to without departing from the spirit and scope of the invention as those skilled in the art will readily understand. Such modifications and variations are considered to be within the purview and scope of the invention and appended claims.

We claim:

1. A fuel preparation and feed system in association with a fluid bed reactor wherein coal is used as fuel, comprising a coal bin, a coal crusher having an inlet for warm drying gas, means for withdrawing coal from said bin and forwarding it to said crusher, separating means connected by a conduit to said crusher for separating said drying gas from the crushed coil, a pneumatic conduit for conveying said crushed coal connected to coal feed guns at said reactor, drying gas conduit means for withdrawing heated low-oxygen gases from said reactor and conducting them to said inlet at said coal crusher, a scrubber arranged to receive exhaust gases from said reactor and conduit means connecting said separating means to said scrubber so that said drying gas separated from said crushed coal is routed to said scrubber for treatment with said exhaust gases prior to discharge from the system.

2. The system of claim 1 wherein said reactor is a multi-compartment fluid-bed calciner comprising a preheat compartment having a windbox, a calciner compartment into which said coal feed guns are directed, and a cooling compartment having a windbox, and wherein said drying gas conduit means is connected to said reactor so that inert combustion gas is withdrawn from the freeboard of said calciner compartment to provide at least a portion of the warm drying gas supplied to said inlet of said coal crusher.

3. The system of claim 2 wherein conduit means is provided connecting with said drying gas conduit to admit tempering gas for blending with said inert combustion gas to lower the temperature of the combined gas to a maximum of 600° F.

4. The system of claim 1 wherein said reactor is a fluid bed incinerator comprising a combustion compartment and wherein said drying gas conduit means is connected to said reactor for withdrawal of hot gas from the freeboard region of said combustion chamber.

5. The system of claim 1 wherein control means is provided for actuating said means for withdrawing coal from said bin, said control means being responsive to a temperature sensor located in a fluidized bed of said reactor.

6. A fuel preparation and feed system in association with a fluid bed reactor wherein coal is employed as the fuel, comprising a coal bin, a coal crusher having a gas inlet for warm drying gas, means for withdrawing coal from said bin and forwarding it to said crusher, separating means connected by a conduit to said crusher for separating said drying gas from the crushed coal, an exhaust gas outlet for discharging a first volume of said separated drying gas from said system, means for conducting the crushed coal from said separating means to a pneumatic conduit, said pneumatic conduit connected to coal feed guns at said reactor, a preheater having a fuel inlet and a burner chamber wherein fuel is burned to produce a volume of gas at elevated temperature, said preheater comprising a tempering chamber having provision for admission of relatively cool gas thereinto, tempering gas conduit means connected to said preheater for routing a second, relatively cool volume of said separated drying gas to said preheater, including said tempering chamber, whereby a volume of warm, inert drying gas may be produced by mixture of said cool gas with said gas at elevated temperature, and a drying gas conduit connecting said tempering chamber to said gas inlet of said crusher.

7. The system of claim 6 wherein control means is provided to regulate the flow of coal to the reactor, said control means actuating said means for withdrawing coal from said bin in response to a temperature indication received from a temperature sensor located in a fluidized bed of said reactor.

8. The system of claim 7 wherein control means is provided to regulate the generation of drying gas and comprises a temperature sensor in the separated drying gas stream and a controllable valve in said fuel inlet of said preheater.

9. In a coal preparation and combustion system wherein coal is burned at a combustion site as fuel, a coal bin, a coal crusher, transport means for withdrawing coal from said bin and forwarding it to said coal crusher, said coal crusher having an inlet for admitting heated gas whereby coal introduced into said crusher for processing is dried as it is comminuted to fine particle size and conveyed therefrom by said gas, a crusher product conduit accommodating said gas-conveyed coal and connecting said crusher to a classifier and gas-solids separating unit, said gas-solids separating unit operating to separate said heated gas from said fine particle coal, a solids handling means connecting said separating unit to a pneumatic carrier conduit whereby said fine particle coal is introduced into said carrier conduit for transport to said combustion site, a drying gas conduit connected to said inlet of said crusher for conducting hot, relatively inert, combustion gases from a combustion reaction toward said crusher inlet and a tempering conduit connected to a source of relatively cool gas and arranged to blend said cool gas with said hot combustion gases ahead of said inlet to produce a predetermined volume of warm, inert gas for drying said coal within said coal crusher.

10. A coal preparation and combustion process comprising the steps of:

(a) Crushing the coal to a predetermined fine particle size, (b) Generating a volume of hot, substantially inert combustion gases in a combustion reaction, (c) Tempering said combustion gases by mixing a volume of relatively cool gases with said hot combustion gases to obtain a mixed volume of warm, substantially inert, gases having a temperature not exceeding 600° F., (d) Passing a stream of said warm gases in contact with said coal as the coal is crushed in accordance with step (a), (e) Introducing the crushed, dried coal into an air stream to convey said coal to a combustion site and (f) Burning said coal at said combustion site.

11. The process of claim 10 wherein the hot, combustion gases generated by burning said coal in accordance with step (f) are tempered by mixture with relatively cool gas in accordance with step (c) and serve to dry said coal in accordance with step (d).

12. The process of claim 10 wherein at least a portion of the warm gases used in drying said coal in accordance with step (d) thereafter serve as the relatively cool gas used for mixing with said hot combustion gas for tempering purposes in accordance with step (c).

13. The process of claim 12 wherein a portion of the gas passed in contact with said coal for drying purposes is exhausted from the system and wherein the quantity of gas exhausted from said system is approximately equal to the air admitted to said system to support the combustion reaction of step (b).

* * * * *